US008281417B2

(12) United States Patent
Godoy

(10) Patent No.: US 8,281,417 B2
(45) Date of Patent: Oct. 9, 2012

(54) SPACE-SAVING SCUBA DIVING MASK

(75) Inventor: Carlos Alberto Godoy, Genoa (IT)

(73) Assignee: Cressi-Sub SA, Genoa (IT)

( * ) Notice: Subject to any disclaimer, the term of this patent is extended or adjusted under 35 U.S.C. 154(b) by 0 days.

(21) Appl. No.: 11/901,382

(22) Filed: Sep. 16, 2007

(65) Prior Publication Data

US 2008/0072365 A1 Mar. 27, 2008

(30) Foreign Application Priority Data

Sep. 15, 2006 (IT) ..... FI20060057 U

(51) Int. Cl.
*A61F 9/02* (2006.01)

(52) U.S. Cl. ..... 2/428; 2/426; 2/427; 2/439; 2/440; 2/454

(58) Field of Classification Search ..... 2/428, 426, 2/427, 452, 453, 454, 450, 448, 449, 440, 2/441; 351/43
See application file for complete search history.

(56) References Cited

U.S. PATENT DOCUMENTS

| | | | | |
|---|---|---|---|---|
| 5,459,882 | A * | 10/1995 | Yamamoto | 2/428 |
| 5,555,571 | A | 9/1996 | McCaffrey | 2/428 |
| 5,642,178 | A | 6/1997 | Leonardi et al. | 351/111 |
| 5,829,064 | A * | 11/1998 | Huang | 2/428 |
| 5,956,778 | A * | 9/1999 | Godoy | 2/428 |
| 6,694,532 | B2 * | 2/2004 | Chen | 2/428 |
| 2001/0014982 | A1 * | 8/2001 | Kawashima et al. | 2/428 |
| 2003/0172445 | A1 * | 9/2003 | Kawashima | 2/452 |

FOREIGN PATENT DOCUMENTS

EP 1454825 9/2004

* cited by examiner

*Primary Examiner* — Alissa Tompkins
(74) *Attorney, Agent, or Firm* — Steinfl & Bruno, LLP

(57) ABSTRACT

A mask for aquatic activities, the mask comprising a relatively rigid frame carrying at least one transparent lens, and a flexible skirt joined with a perimeter of the frame. The mask also includes a strap for holding the mask against a user's head and buckles for adjusting the length of the strap. The buckles are joined with lateral sides of the frame by brackets extending from the lateral sides. The brackets are made of a selected flexible material.

3 Claims, 2 Drawing Sheets

SPACE-SAVING SCUBA DIVING MASK

FIELD OF THE INVENTION

The present invention relates generally to space-saving and, more particularly, to storage of equipment for aquatic activities and the like.

BACKGROUND OF THE INVENTION

Scuba diving masks typically comprise a rigid frame supporting a transparent lens, or "visor". A flexible gasket or "skirt"is attached to a perimeter of the frame suitably for resting against a scuba diver's face so as to provide necessary water tightness. In another mask arrangement, the frame is constructed in two parts, the "visor", in this regard, having two generally symmetrical lens elements. A support strap, joined to either side of the mask, is also provided to ensure a snug fit between the mask and the diver's face.

Additionally, each end of the support strap is provided with a buckle that allows adjustment of the strap's length so as to enable the mask to be adapted to the dimensions of the diver's head. Notably, the buckles may be joined to the sides of either the rigid frame or the "skirt".

Where the buckles are joined to the sides of the frame, a pair of brackets are provided which lie substantially perpendicular to the plane of the visor. The brackets also face the rear of the mask, and extend rigidly from the mask frame. Consequently, the brackets are aligned with the direction that the ends of the support strap tend to occupy when the mask is worn on the diver's face. The brackets are usually as rigid as the mask frame so that the overall dimensions of the mask increase in a direction generally perpendicular to the plane of the visor. While useful, this mask configuration, upon storage and/or transportation, requires placement of the mask in a container of suitable size and dimensions thereby increasing space requirements and, thus, the cost of transportation. This configuration has also been found problematic for the user, particularly when the mask must be stored.

Where the buckles on the straps are attached directly to the flexible skirt, although the mask's overall dimensions for transportation and/or storage have been found to be of considerably less difficulty for the user, this arrangement has other disadvantages that have lead to its limited use.

First, any strap-tightening by the diver changes the shape of the flexible skirt, causing unavoidable loss of watertightness when tightening of the strap is performed underwater. Second, adjustment of the mask exerts a tensile force or stress on the flexible skirt and, more particularly, where the buckle is attached. After a number of adjustment operations have occurred, this stress causes the skirt to rupture, thereby rendering the mask unusable.

OBJECTS AND SUMMARY OF THE INVENTION

Accordingly, it is an object of the present invention to provide a mask for aquatic activities that avoids loss of watertightness during strap-tightening by a diver when the mask is in use underwater.

Another object of the present invention is to provide a mask for aquatic activities that avoids exertion of a tensile force or stress during mask adjustment and, in turn, rupture of the skirt.

A further object of the present invention is to provide a mask for aquatic activities a configuration that not only makes the mask inexpensive to transport, but also facilitates ease of storage by a diver when not in use.

Yet another object of the present invention is to provide a scuba diving mask with a connection between the mask frame and adjustment strap that allows the overall dimensions of the mask to be reduced when the mask is placed in a box for packaging and dispatch operations, and/or for storage after use, without risk of damage to the skirt upon repetitive adjustment of the strap's length, as is typically done by a diver during use.

According to one aspect of the present invention, a mask for aquatic activities is provided. The mask comprises a relatively rigid frame carrying at least one transparent lens, a flexible skirt joined with a perimeter of the frame, a strap for holding the mask against a user's head, and buckles for adjusting the length of the strap. The buckles are joined to lateral sides of the frame by brackets extending from the lateral sides, the brackets being made of a selected flexible material.

In accordance with another aspect of the present invention, there is provided a mask for aquatic activities, the mask comprising a frame carrying a plurality of transparent lenses, a flexible skirt joined to a perimeter of the frame, a strap for holding the mask against a user's head, and buckles for adjusting the length of the strap. The buckles are joined with lateral sides of the frame by brackets extending from the lateral sides. The brackets are made of a selected flexible material for inward foldability on inner surfaces of the lenses.

According to a further aspect of the present invention, a mask for aquatic activities is provided. The mask comprises a relatively rigid frame carrying at least one transparent lens, a flexible skirt joined to a perimeter of the frame for covering substantially the user's face and forming a watertight seal therewith, the skirt substantially surrounding each eye portion of the mask and including a nosepiece which covers the nose in its entirety, and a strap for holding the mask against a user's head, the strap having opposing ends. In addition, the mask has buckles mounted to the strap, one buckle in proximity to each strap end, for adjusting the length of the strap. The buckles are joined respectively to lateral sides of the frame by brackets formed in and with the lateral frame sides, adjacent the at least one lens, the brackets extending from the lateral sides. The brackets are made of a flexible material such that one or more grooves formed in outwardly facing sides of the brackets, and lying parallel to the plane of the at least one lens, facilitate folding of the brackets inwardly into a generally parallel relationship with the lens.

In accordance with still another aspect of the present invention, there is provided a mask for aquatic activities. The mask has a frame carrying a plurality of transparent lenses, a flexible skirt joined to a perimeter of the frame for covering substantially the user's face and forming a watertight seal therewith, the skirt substantially surrounding each eye portion of the mask and including a nosepiece which covers the nose in its entirety, and a strap for holding the mask against a user's head, the strap having opposing ends. Buckles are mounted to the strap, one buckle in proximity to each strap end, for adjusting the length of the strap, the buckles being joined respectively to lateral sides of the frame by brackets formed in and with the lateral frame sides, adjacent the respective lenses. The brackets extend from the lateral sides in a plane that is substantially perpendicular to the frame. Also, the brackets are made of a flexible material such that one or more grooves formed in outwardly facing sides of the brackets, and lying parallel to the plane of the respective lenses, facilitate inward foldability on inner surfaces of the lenses.

BRIEF DESCRIPTION OF THE DRAWINGS

A specific, illustrative space-saving scuba diving mask, according to the present invention, is described below with reference to the accompanying drawings, in which.

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
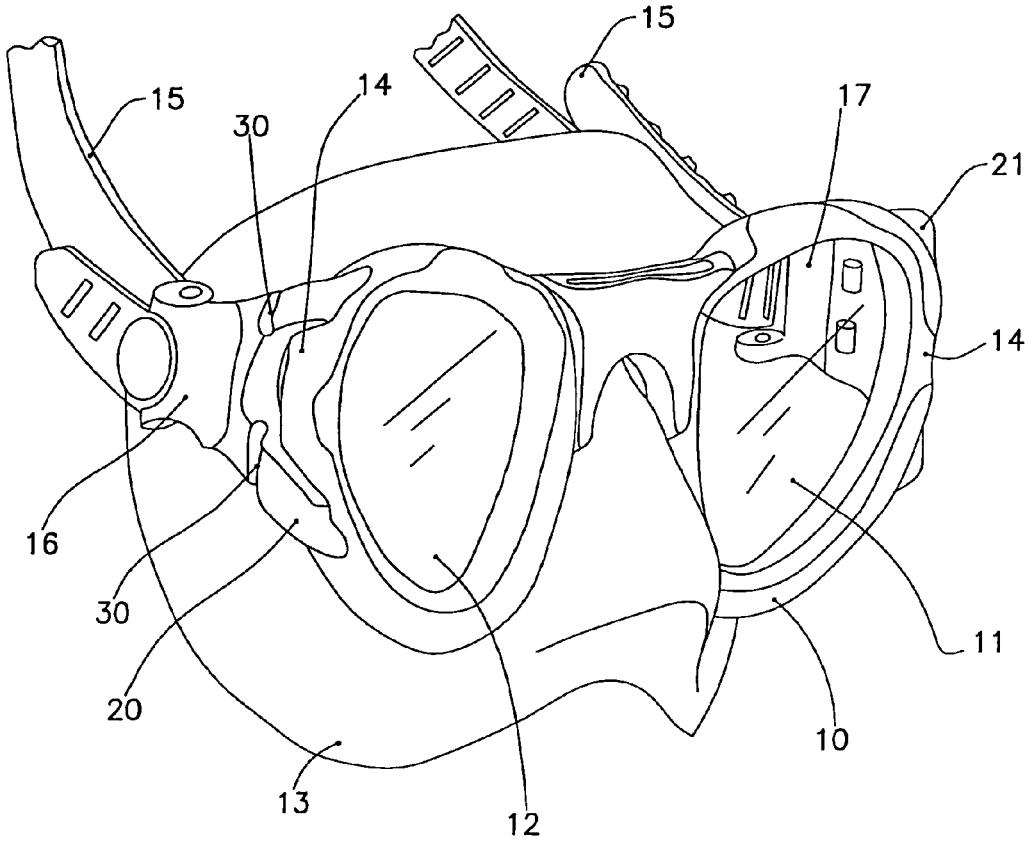
FIG. 1 is a perspective view of a scuba diving mask, according to one aspect of the present invention.
Figure 2:
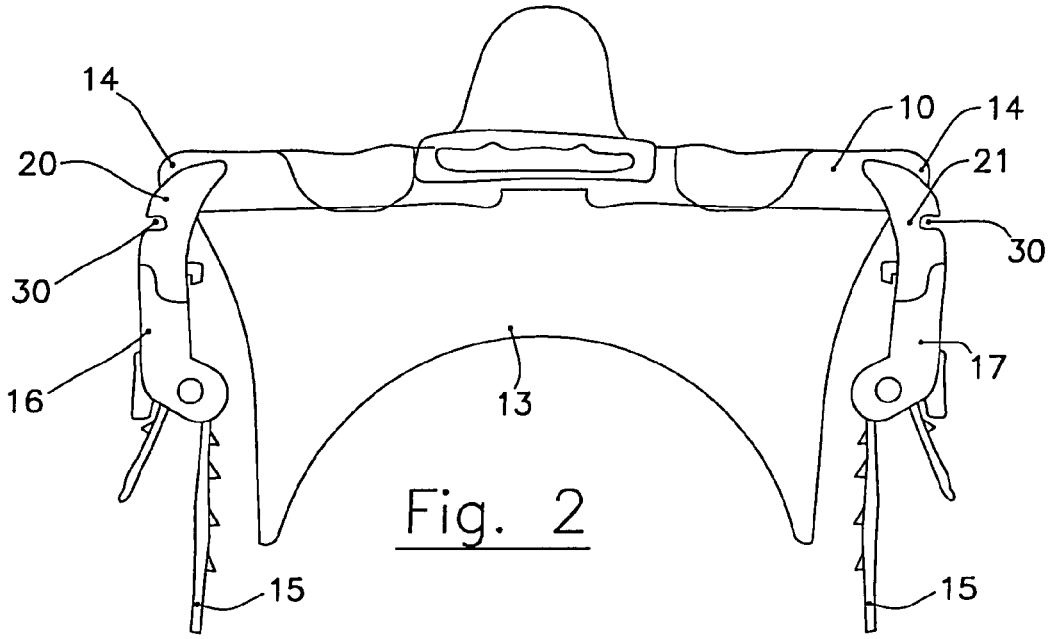
FIG. 2 is a plan view of the mask shown in FIG. 1.

Referring now to the drawings and, more particularly, to FIGS. 1-4, there is shown generally a specific, illustrative space-saving mask, according to various aspects of the present invention. In one embodiment, illustrated generally in FIG. 1, the mask has a relatively rigid frame 10 that includes, for instance, a pair of visors or lenses, 11 and 12. Desirably, a flexible skirt 13 is attached integrally to a perimeter of the frame by a watertight connection. In addition, a flexible strap 15 is provided having its two ends joined with buckles 16 and 17, respectively, so as to allow the length of the strap to be adjusted.

Buckles 16 and 17 are preferably attached to lateral sides 14 of the frame by brackets 20 and 21, respectively, extending in a plane that is substantially perpendicular to the frame. The brackets are desirably made of a selected flexible material. The buckles, also constructed of a selected flexible material, are molded directly to the material of the frame, the respective materials preferably being joined with one another via a chemical bond. Suitable materials include, but are not limited to, a selected thermoplastic rubber and a suitable polycarbonate. Optionally, brackets 20 and 21 are joined with buckles 16 and 17 by conventional coupling arrangements, such as a pivot or the like (not shown).

Figure 3:
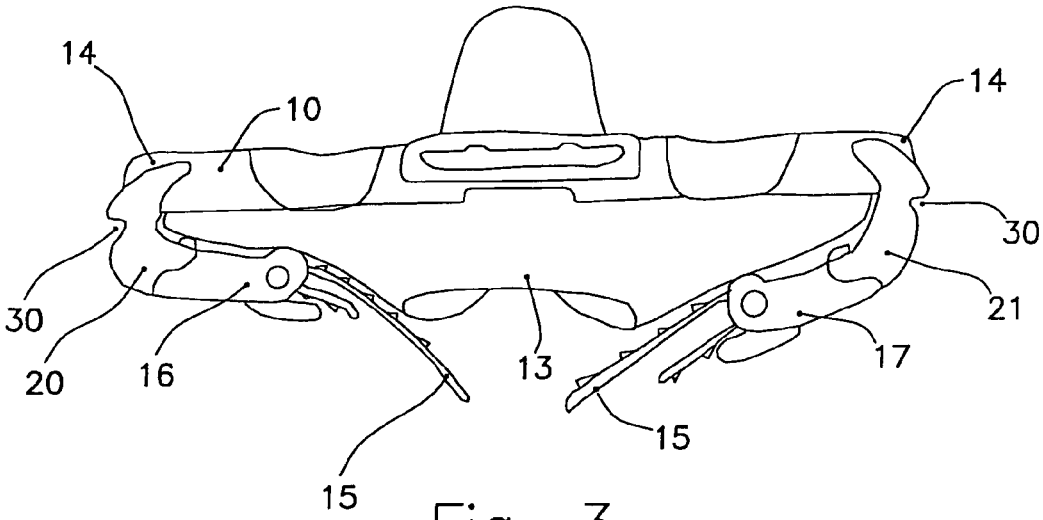
FIG. 3 is a plan view of the mask illustrated in FIG. 1 in a folded position.

As illustrated generally in FIG. 3, a mask, according to the present invention, and its many benefits are shown in plan view with buckles 16 and 17 positioned substantially against the frame of the mask through ready folding of the brackets. For greater ease in folding, the brackets are preferably provided with one or more grooves 30 which reduce substantially the respective cross-sections of the brackets.

In this manner, the present invention advantageously reduces the overall dimensions of the mask, thereby making its transportation from manufacturer to retailer considerably easier and less expensive. Moreover, because of the significant reduction in mask dimensions the user may readily place the mask in his/her pocket, e.g., of normal size, or even in a standard size glasses case.

Various modifications and alterations to the present invention maybe appreciated based on a review of this disclosure. These changes and additions are intended to be within the scope and spirit of the invention as defined in by the following claims.

What is claimed is:

1. A mask for aquatic activities, which comprises a relatively rigid frame carrying at least one transparent lens, a flexible skirt joined to a perimeter of the frame for covering substantially the user's face and forming a watertight seal therewith, the skirt substantially surrounding each eye portion of the mask and including a nosepiece which covers the nose in its entirety, a strap for holding the mask against a user's head, the strap having opposing ends, and buckles mounted to the strap, one buckle in proximity to each strap end, for adjusting the length of the strap, the buckles being joined respectively to lateral sides of the frame by brackets formed in and with the lateral frame sides, adjacent the at least one lens, the brackets extending from the lateral sides, wherein the brackets are made of a flexible material such that one or more grooves formed in outwardly facing sides of the brackets, and lying parallel to the plane of the at least one lens, facilitate folding of the brackets inwardly into a generally parallel relationship with the lens.

2. The mask set forth in claim 1, wherein the brackets are molded directly to the frame.

3. A mask for aquatic activities, which comprises a frame carrying a plurality of transparent lenses, a flexible skirt joined to a perimeter of the frame for covering substantially the user's face and forming a wateright seal therewith, the skirt substantially surrounding each eye portion of the mask and including a nosepiece which covers the nose in its entirety, a strap for holding the mask against a user's head, the strap having opposing ends, and buckles mounted to the strap, one buckle in proximity to each strap end, for adjusting the length of the strap, the buckles being joined respectively to lateral sides of the frame by brackets formed in and with the lateral frame sides, adjacent the respective lenses, the brackets extending from the lateral sides in a plane that is substantially perpendicular to the frame, wherein the brackets are made of a flexible material such that one or more grooves formed in outwardly facing sides of the brackets, and lying parallel to the plane of the respective lenses, facilitate inward foldability on inner surfaces of the lenses.

* * * * *